US005524605A

United States Patent [19]

Niwa

[11] Patent Number: 5,524,605

[45] Date of Patent: Jun. 11, 1996

[54] COOKING BURNER

[75] Inventor: Osamu Niwa, Aichi-ken, Japan

[73] Assignee: Toyotomi Co., Ltd., Aichi-ken, Japan

[21] Appl. No.: 394,888

[22] Filed: Feb. 27, 1995

[51] Int. Cl.[6] ..... F24C 3/00

[52] U.S. Cl. ..... 126/39 J; 126/4; 126/92 AC

[58] Field of Search ..... 126/39 R, 39 J, 126/92 AC, 39 K, 91 R, 39 E, 4, 92 C, 41 R, 39 H; 431/215, 329, 328, 327

[56] References Cited

U.S. PATENT DOCUMENTS

| | | | |
|---|---|---|---|
| 3,525,325 | 8/1970 | Perl | 126/39 J |
| 3,646,927 | 3/1972 | Perl | 126/39 J |
| 3,663,798 | 5/1972 | Speidel | 126/39 J |

FOREIGN PATENT DOCUMENTS

| | | |
|---|---|---|
| 46-25561 | 9/1971 | Japan . |
| 50-31814 | 9/1975 | Japan . |
| 53-50620 | 12/1978 | Japan . |
| 1-64978 | 6/1989 | Japan . |
| 2-20193 | 2/1990 | Japan . |
| 2-40936 | 9/1990 | Japan . |

*Primary Examiner* James C. Yeung
*Attorney, Agent, or Firm* Pollock, Vande Sande & Priddy

[57] ABSTRACT

A non-open fire type cooking burner capable of exhibiting endurance, workability and safety. Heat combustion or exhaust gas produced by combustion in a burner body are guided to a heat exchanger made of metal and discharged through an exhaust pipe to an exterior of a room, respectively. The heat is then radiated to a ceramic plate arranged above the heat exchanger for cooking. An air shifter provided with an air-direction change-over damper is arranged so as to change over flowing of air, to thereby permit the cooking burner to be applied to space heating as well as cooking.

3 Claims, 2 Drawing Sheets

COOKING BURNER

BACKGROUND OF THE INVENTION

This invention relates to a cooking burner, and more particularly to a cooking burner wherein heat and exhaust gas produced by combustion of heat source such as fuel oil, fuel gas or the like are subject to heat exchange in a heat exchanger and heat obtained in the heat exchanger is selectively used for cooking and space heating as desired.

Conventionally, an open fire type cooking range or burner has been used to apply a flame directly to a food for cooking. Other than such an open fire type cooking burner, a gas cooking range or burner is proposed as disclosed in Japanese utility Model Publication No. 25561/1971, which is so constructed that a top plate made of a ceramic material is arranged on an upper surface of a box having an infrared burner body received therein, to thereby apply heat indirectly to a food for cooking. Another cooking oven or burner of the non-open fire type is disclosed in Japanese Utility Model Publication No. 31814/1975, which includes a hot plate arranged above a burner body and a cooking plate made of a pottery material and arranged above the hot plate. Further, Japanese Utility Model Publication No. 50620/1978 discloses a further cooking burner of the non-open fire type, which includes a burner body arranged in a combustion chamber and a heat-permeable plate made of a transparent glass ceramic material and arranged above the combustion chamber. The conventional non-open fire type cooking ranges or burners thus proposed each are adapted to carry out cooking by radiation and discharge exhaust gas produced by combustion to a room in which the burner is placed.

Further, Japanese Patent Publication No. 40936/1990 discloses a stove for both cooking and space heating, which is so constructed that combustion gas produced in a heating chamber above a burner body is discharged to an ambient atmosphere and air is introduced between a heating plate arranged in the heating chamber and a cover overlying the heating plate, resulting in carrying out space heating as well as cooking.

The assignee proposed cooking burners of the combustion-exhaust type in both Japanese Utility Model Application No. 64978/1989 and Japanese Utility Model Application No. 20193/1990. The former is adapted to carry out cooking on an upper plate defining a hot gas passage and the latter includes in addition to the construction of the former, a convection fan for applying air to remaining heat to form hot air, which is then forcibly blown out. The proposed cooking burners are suitable for cooking and space heating in a relatively small living space such as a sailing boat, a power boat, a camping car, a camping tent or the like.

In a cooking burner of the outdoor exhaust type used in a relatively small living space such as a sailing boat, a camping car or the like, it is generally required to provide satisfactory airtightness or gastightness between a metal side plate for a combustion chamber and a non-metal upper plate of the combustion chamber which is sufficient to prevent leakage of combustion gas or exhaust gas. Also, the upper plate of he combustion chamber which is made of a non-metal material fails to exhibit sufficient resistance to shock.

Further, a cooking range or burner is generally increased in manufacturing cost because various kinds of electric and electronic parts are incorporated therein. Therefore, it is highly desired that the cooking burner is multipurpose. Also, when the cooking burner is used in a relatively small space, it is required to prevent odor, exhaust gas and heat from being accumulated in the space.

SUMMARY OF THE INVENTION

The present invention has been made in view of the foregoing disadvantage of the prior art.

Accordingly, it is an object of the present invention to provide a cooking burner which is capable of permitting manufacturing, repairing and parts replacement of the burner to be facilitated.

It is another object of the present invention to provide a cooking burner which is capable of permitting the manufacturing cost to be substantially reduced.

It is a further object of the present invention to provide a cooking burner which is capable of significantly improving heat transfer.

It is still another object of the present invention to provide a cooking burner which is capable of being applied to space heating as well as cooking.

It is a still further object of the present invention to provide a cooking burner which is capable of carrying out cooking with high safety.

In accordance with the present invention, a cooking burner is provided. The cooking burner includes a burner body and a heat exchanger for carrying out heat exchange and guiding exhaust gas produced in the burner body therethrough. The heat exchanger is made of metal into a flat configuration and arranged so as to communicate with the burner body. The cooking burner also includes an exhaust pipe connected to the heat exchanger so as to permit the heat exchanger to communicate with an exterior of the cooking burner and a ceramic plate arranged above the heat exchanger in a manner to be in proximity to the ceramic plate.

In a preferred embodiment of the present invention, the cooking burner also includes an air duct arranged so as to surround side and bottom portions of the heat exchanger. The air duct is formed with an air inlet. The cooking burner further includes an air fan including an air suction port which permits the air fan to communicate with the air duct and an air outlet. The air inlet is formed at a portion of the air duct positioned at the side portion of the heat exchanger or ceramic plate. Further, the cooking burner includes an air passage arranged so as to communicate with the air fan and an air shifter arranged at an end portion of the air passage contiguous to the air outlet of the air fan and actuated so as to selectively direct air fed from the air fan toward an upper surface of the ceramic plate.

In a preferred embodiment of the present invention, the cooking burner also includes an exhaust duct, wherein the air shifter includes an air-direction change-over damper connected to the exhaust duct, the exhaust duct is arranged so as to extend from the air-direction change-over duct to an exterior of the cooking burner and the air-direction change-over damper functions to selectively feeding air fed from the air fan to the upper surface of the ceramic plate and the exhaust duct.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals designate like or corresponding parts throughout; wherein.

DETAILED DESCRIPTION OF THE PREFERRED EMBODIMENT

Now, a cooking burner according to the present invention will be described hereinafter with reference to the accompanying drawings.

Figure 1:
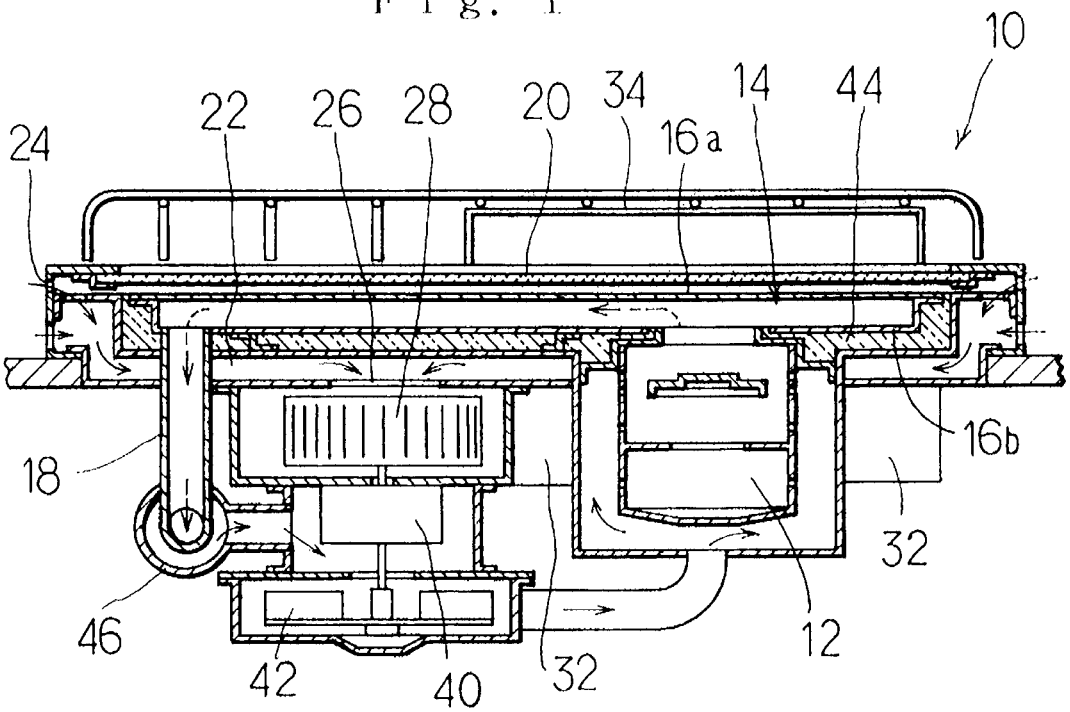
FIG. 1 is a front elevation view in section showing an essential part of an embodiment of a cooking burner according to the present invention.
Figure 2:
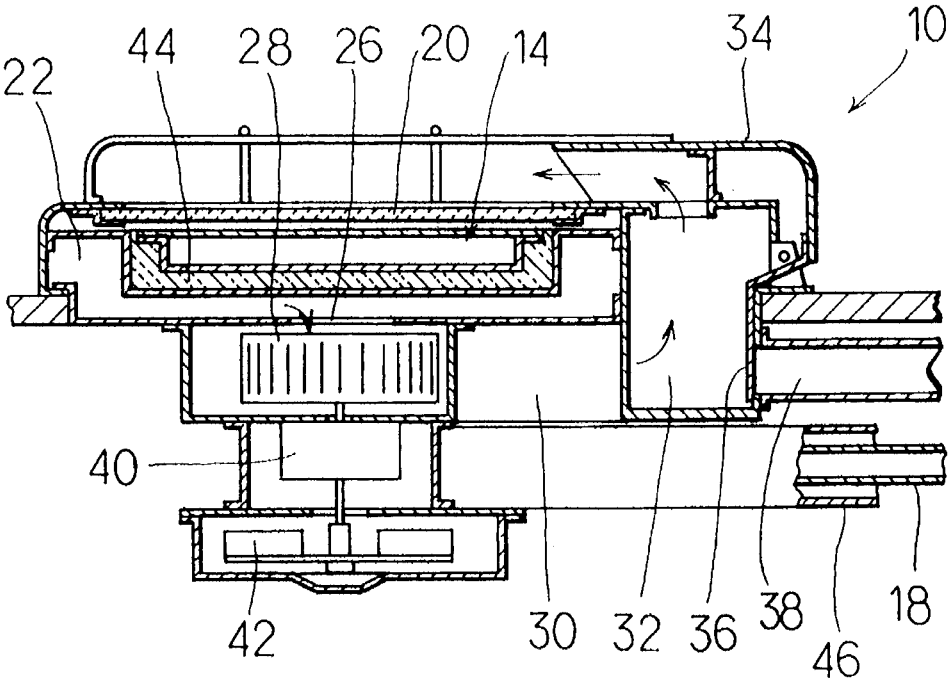
FIG. 2 is a side elevation view in section of the cooking burner of FIG. 1, wherein an air shifter is oriented to an upper surface of a ceramic plate.
Figure 3:
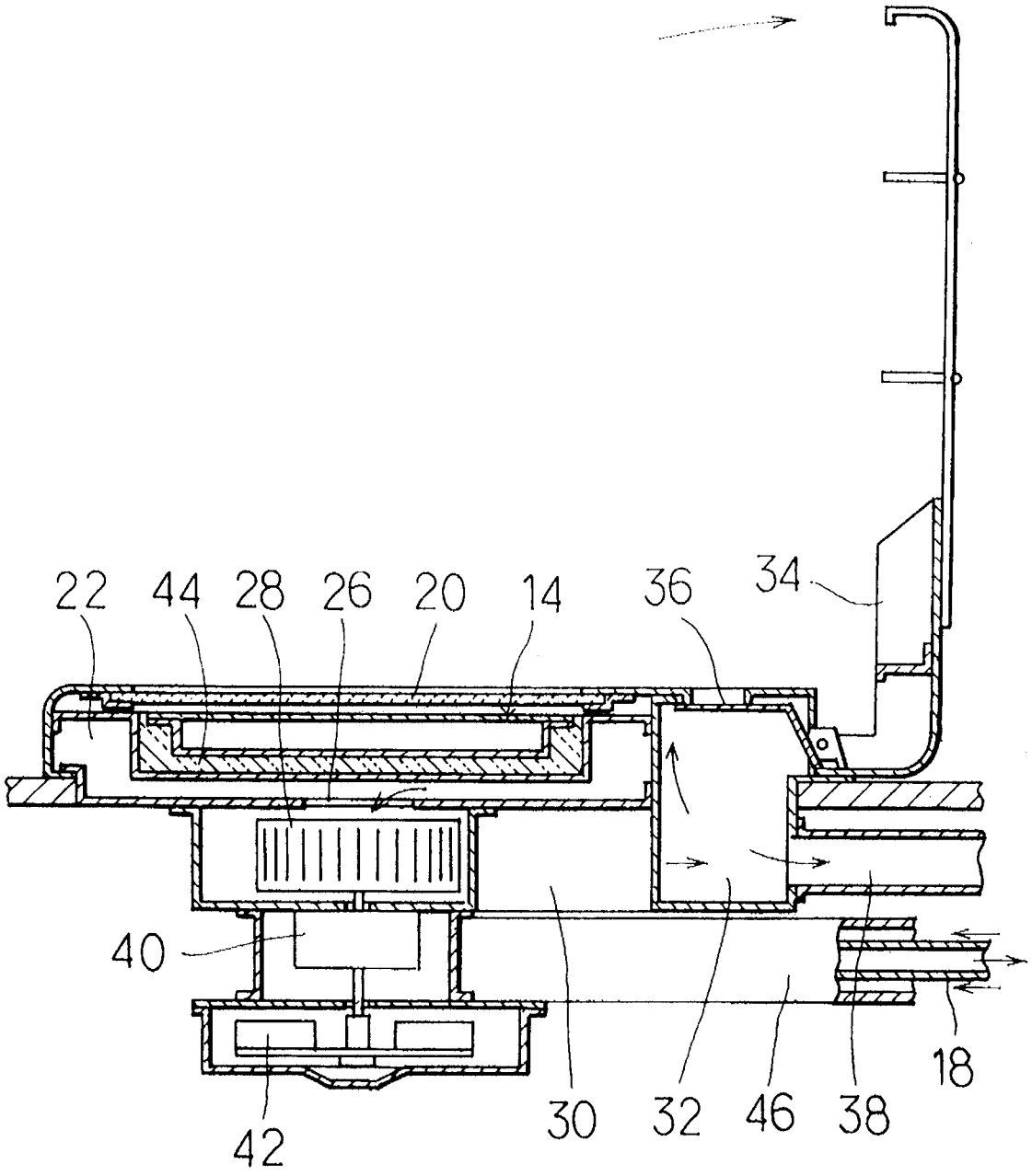
FIG. 3 is a side elevation view in section of the cooking burner of FIG. 1, wherein an air shifter is oriented in a direction away from a ceramic plate.

Referring to FIGS. 1 to 3, an embodiment of a cooking burner according to the present invention is illustrated. A cooking burner of the illustrated embodiment is generally designated at reference numeral 10 and includes a burner body 12, which is constructed into an oil-fired pot-type structure. However, the cooking burner of the present invention may be applied to various kinds of fuel, as well as various kinds of combustion systems. The cooking burner 10 also includes a heat exchanger 14 for subjecting heat generated by combustion in the burner body 12 to heat exchange and passing combustion gas produced by the combustion therethrough. For this purpose, the heat exchanger 14 is formed of two metal plates 16*a* and 16*b* arranged opposite to each other with a small gap being defined therebetween. The two metal plates 16*a* and 16*b* are joined at a periphery thereof to each other, so that the heat exchanger 14 is formed into a flat configuration. The heat exchanger 14 has an exhaust pipe 18 connected thereto so as to outwardly discharge the above-described combustion gas from the heat exchanger 14 therethrough as indicated at arrows of dotted lines in FIG. 1.

The cooking burner 10 further includes a ceramic plate 20 arranged above the heat exchanger 14 in a manner to be in proximity to the heat exchanger 14. The ceramic plate 20 is desirably made of a heat-resistance and corrosion-resistant material exhibiting satisfactory far-infrared radiating properties such as porcelain glass, transparent heat-resistant glass or the like.

In addition, the cooking burner 10 of the illustrated embodiment includes an air duct 22 arranged so as to extend on an outside of lower and side portions of the heat exchanger 14 or surround the portions. In the illustrated embodiment, the air duct 22 may act also as a support frame for the burner body 12. The air dust 22 is formed with an air inlet 24 in a manner to be positioned outside the heat exchanger 14 and/or ceramic plate 20, so that ambient air may be introduced through the air inlet 24 into the air duct 22 as indicated at arrows of solid lines in FIG. 1. Also, the air duct 22 is formed with an air suction port 26 and provided therein with an air fan 28 in a manner to be opposite to the air suction port 26. The air fan 28 is provided with an air outlet 30 as shown in FIGS. 2 and 3, which is arranged so as to communicate with an air passage 32 provided in the cooking burner 10 so as to guide air therethrough.

The cooking burner 10 of the illustrated embodiment further includes a wind or air shifter 34 arranged at an end of the air passage 32, which functions as an air guide for orienting air flow in a desired direction. More particularly, it serves to selectively guide air upward of the cooking burner 10 or to a surface of the ceramic plate 20 as desired.

Reference numeral 36 designates an air-direction change-over damper formed integrally with the air shifter 34 and 38 is an exhaust duct or passage arranged so as to outwardly extend from the air passage 32 to, for example, an exterior of a kitchen or a room in which the cooking burner 10 is placed. The air-direction change-over damper 36 functions to selectively forcibly feed air flowing through the air passage 32 through the air shifter 34 to the surface of the ceramic plate 20 or outwardly discharge it to the exterior of the room as desired.

In the illustrated embodiment, as will be noted from the above, the air shifter 34 is constructed so as to be actuated in association with the air-direction change-over damper 36. Alternatively, the illustrated embodiment may be so constructed that the air shifter 34 is arranged so as to be fixed relative to the ceramic plate 20 and the air-direction change-over damper 36 is movably arranged so as to change over, between the ceramic plate 20 and the exhaust duct 38, a direction of flowing of air.

The air fan 28 is driven by a motor 40. Reference numeral 42 is a combustion air fan 42 for feeding combustion air to the burner body 12. The air fun 28 and combustion air fan 42 may be preferably mounted on the motor 40 in a manner to be coaxial with each other. Thus, combustion gas produced from combustion air and fuel in the burner body 10 is forcibly discharged by the combustion air fun 42. This requires to fully airtightly seal the heat exchanger 14. Unfortunately, the prior art wherein a heat exchanger is partially formed of a ceramic plate fails to provide such airtight sealing of the heat exchanger. Thus, airtight sealing of the heat exchanger in the prior art leads to a significant increase in manufacturing cost and complication in structure. On the contrary, the present invention is so constructed that the heat exchanger 14 and ceramic plate 20 are formed separately from each other, to thereby facilitate sealed airtightness of the heat exchanger 14. This permits the manufacturing cost to be substantially reduced.

Reference numeral 44 designates a heat insulating material arranged so as to surround the side and bottom portions of the heat exchanger 14. Thus, the heat insulating material 44 prevents substantial leakage of heat from the heat exchanger 14, to thereby permit a large part of heat of the heat exchanger 14 to be discharged through an upper surface thereof. 46 is an air feed pipe for feeding combustion air to the combustion air fan 42 as indicated at arrows in FIG. 3. In the illustrated embodiment, the air feed pipe 46 introduces air from the outside of the cooking burner 10.

Now, the manner of operation of the cooking burner 10 of the illustrated embodiment will be described hereinafter.

When the burner body 12 of the cooking burner 10 is fed with suitable fuel in the form of oil, gas or the like and then ignited, combustion takes place in the burner body 12 to produce heat and combustion gas, which are guided through the heat exchanger 14 formed of metal into a flat configuration to the exhaust pipe 18. Then, the combustion gas is discharged in the form of exhaust gas to an exterior of a room in which the cooking burner 10 is placed. The heat produced permits the heat exchanger 14 to be heated to an elevated temperature, so that the heat exchanger 14 thus heated may radiate heat, which then heats the ceramic plate 20 to a temperature sufficient for cooking.

Actuation of the air fan 28 causes air to be introduced through the air inlet 24 into the air duct 22, which air absorbs heat laterally and downwardly radiated from the heat exchanger 14, followed by flowing to the air suction port 26 of the air fan 28. Then, the air is fed from the air outlet 30 of the air fan 28 through the air passage 32 to the air shifter 34. The air shifter 34 functions to guide the air. For example, during cooking, it flows the air in a direction away from the ceramic plate 20.

When it is desired to operate the cooking burner for space heating rather than cooking, the air shifter 34 is oriented toward the upper surface of the ceramic plate 20 while continuing combustion of the burner body 12, resulting in air being fed from the air passage 32 to a position above the ceramic plate 20. This causes the air to be warm, which is then discharged to the room for space heating.

The air shifter 34, as described above, is provided with the air-direction change-over damper 36 and the exhaust duct 38 is provided so as to extend from the air-direction change-over damper 36 to the exterior of the cooking burner 10, so that actuation of the air-direction change-over damper 36 causes a direction of flowing of air fed from the air fan 26 to be shifted. More specifically, during cooking, the air-direction change-over damper 36 is kept changed over so as to open the exhaust duct 38 and close the air shifter 34, to thereby guide air fed from the air fan 28 through the exhaust duct 38 to the exterior of the cooking burner 10, as shown in FIG. 3. Whereas during space heating, the air-direction change-over damper 36 is kept changed over so as to close the exhaust duct 38 and open the air shifter 34, to thereby guide the air through the air shifter 34 to the surface of the ceramic plate 20, as shown in FIG. 2.

As can be seen from the foregoing, the cooking burner 10 of the present invention is constructed so as to prevent combustion flame from being applied directly to cooking utensils. In the present invention, the ceramic plate 20 and heat exchanger 14 arranged at an upper portion of the cooking burner 10 are formed separately from each other. Thus, the cooking burner 10 of the present invention can be readily manufactured and permits repairing and parts replacement of the burner to be facilitated.

Also, in the present invention, the heat exchanger 14 is made of metal into a flat configuration. Thus, it may be readily manufactured by any suitable means such as pressing, casting or the like while being provided with airtightness sufficient to prevent leakage of combustion gas, resulting in substantial cost savings irrespective of being the exhaust type. Also, formation of the heat exchanger 14 into a flat configuration permits a heat radiation area to be increased, so that transfer of heat from the heat exchanger 14 to the ceramic plate 20 may be carried out with high efficiency. For example, the cooking burner 10 of the present invention may be applied in such a manner that cooking takes place on a first portion of the ceramic plate 20 immediately above the burner body 12 and warming is carried out on a second portion of the ceramic plate 20 somewhat away from the first portion.

Further, in the present invention, the heat exchanger 14 discharges a part of heat in lateral or downward directions thereof irrespective of arrangement of the heat insulating material 44, which heat is then absorbed by air forcedly fed through the air fan 28 and thereafter fed to the upper surface of the ceramic plate 20 by means of the air shifter 34, resulting in being used for space heating. Further, during cooking on the ceramic plate 20, the air-direction change-over damper 36 is so actuated so as to discharge combustion heat to an exterior of the cooking burner 10 while being carried on combustion gas rather than feed air to the ceramic plate 20, resulting in preventing storage of heat below the heat exchanger 14.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A cooking burner comprising:

a burner body constructed so as to upwardly discharge combustion gas;

a first metal plate of a flat shape for acting as a guide plate for guiding combustion gas discharged from said burner body;

a ceramic plate arranged so as to be opposite to said guide plate for permitting cooking to be carried out thereon by means of heat discharged from said burner body;

a heat insulating plate arranged under said guide plate for promoting transfer of heat for cooking to said ceramic plate;

a second metal plate arranged between said guide plate and said ceramic plate for acting as a heating plate and defining a gap between said heating plate and a lower surface of said ceramic plate, said heating plate being arranged so as to permit an outer periphery thereof to be closely associated with said guide plate, and said guide plate and said heating plate cooperating with each other to provide a combustion gas guide means for acting as a heat exchanger to transfer combustion gas heat for cooking to said ceramic plate; and, an exhaust pipe connected to a portion of said guide plate positioned apart from said burner body so that combustion gas generated in said burner body is guided through said heat exchanger to said exhaust pipe and is prevented from touching said ceramic plate.

2. A cooking burner as defined in claim 1, further comprising an air duct arranged so as to surround side and bottom portions of said heat exchanger;

said air duct being formed with an air inlet;

an air fan including an air suction port which permits said air fan to communicate with said air duct and an air outlet;

said air inlet being formed at a portion of said air duct positioned at the side portion of said heat exchanger or ceramic plate;

an air passage arranged so as to communicate with said air fan; and an air shifter arranged at an end portion of said air passage contiguous to said air outlet of said air fan and actuated so as to selectively direct air fed from said air fan toward an upper surface of said ceramic plate.

3. A cooking burner as defined in claim 2, further comprising an exhaust duct;

said air shifter including an air-direction change-over damper connected to said exhaust duct;

said exhaust duct being arranged so as to extend from said air-direction change-over duct to an exterior of the cooking burner;

said air-direction change-over damper selectively feeding air fed from said air fan to said upper surface of said ceramic plate and said exhaust duct.

* * * * *